US010188195B2

(12) United States Patent
Burditt, Jr. et al.

(10) Patent No.: US 10,188,195 B2
(45) Date of Patent: Jan. 29, 2019

(54) DECORATIVE WIPERS FOR COSMETIC CONTAINERS

(71) Applicant: HCT GROUP HOLDINGS LIMITED, Central (HK)

(72) Inventors: Stephen Charles Burditt, Jr., Los Angeles, CA (US); Tania Miren Diaz, Santa Monica, CA (US)

(73) Assignee: HCT GROUP HOLDINGS LIMITED, Hong Kong (HK)

( * ) Notice: Subject to any disclaimer, the term of this patent is extended or adjusted under 35 U.S.C. 154(b) by 195 days.

(21) Appl. No.: 15/205,205

(22) Filed: Jul. 8, 2016

(65) Prior Publication Data

US 2017/0007006 A1 Jan. 12, 2017

Related U.S. Application Data

(60) Provisional application No. 62/191,181, filed on Jul. 10, 2015.

(51) Int. Cl.

| | |
|---|---|
| ***A46B 17/08*** | (2006.01) |
| ***A45D 40/26*** | (2006.01) |
| ***A45D 34/04*** | (2006.01) |

(52) U.S. Cl.
CPC ..... *A45D 40/267* (2013.01); *A45D 34/046* (2013.01); *A45D 2200/05* (2013.01)

(58) Field of Classification Search
CPC ..... A45D 40/267; A45D 34/046
USPC ..... 401/122
See application file for complete search history.

(56) References Cited

U.S. PATENT DOCUMENTS

| | | | | | |
|---|---|---|---|---|---|
| 3,938,686 | A | | 2/1976 | Milligan et al. | |
| 4,194,848 | A | | 3/1980 | Kingsford | |
| 4,282,891 | A | | 8/1981 | Duceppe | |
| 4,433,928 | A | | 2/1984 | Kingsford | |
| 4,437,477 | A | | 3/1984 | Gueret | |
| 4,470,425 | A | | 9/1984 | Gueret | |
| 4,628,950 | A | * | 12/1986 | Bitzer | A45D 40/268 132/218 |
| 4,810,122 | A | | 3/1989 | Cole | |
| 5,111,946 | A | | 5/1992 | Glanz | |
| 5,137,387 | A | * | 8/1992 | Byrd | A45D 40/267 401/122 |
| 5,332,325 | A | | 7/1994 | Crosnier et al. | |
| 5,743,279 | A | | 4/1998 | Gueret | |
| 5,884,634 | A | * | 3/1999 | Sheffler | A45D 34/046 132/218 |

(Continued)

*Primary Examiner* — Jennifer C Chiang
(74) *Attorney, Agent, or Firm* — Seager, Tufte & Wickhem LLP

(57) ABSTRACT

Decorative wiper having a first end and a second end. The first end, which is adapted to be placed at the opening or upper end of a cosmetic bottle, has an opening with a decorative design. The second end, which is adapted to sit farther within the cosmetic bottle, has a narrowed opening in a manner typical of cosmetic wipers to a generally circular profile. Between the first end and the second end is a lumen or passage through which the cosmetic applicator may pass. The second end serves to wipe away excess product, in a manner similar to conventional wipers. The first end provides an aesthetically pleasing, or brand-defining useful, design. Between the two ends the interior walls of the wiper define the lumen or passage by tapering outward from the first end wiper to the second end.

19 Claims, 10 Drawing Sheets

(56) References Cited

U.S. PATENT DOCUMENTS

| | | | | |
|---|---|---|---|---|
| 5,937,869 | A * | 8/1999 | Lhuisset | A45D 40/267 132/218 |
| 6,033,142 | A * | 3/2000 | Gueret | A45D 34/046 401/122 |
| 6,168,334 | B1 | 1/2001 | Fordham | |
| 6,280,112 | B1 * | 8/2001 | Vieu | A45D 34/042 401/122 |
| 6,305,861 | B1 | 10/2001 | Gueret | |
| 6,315,140 | B1 * | 11/2001 | Nadel | A45D 40/265 215/228 |
| 6,408,857 | B1 | 6/2002 | Neuner | |
| 6,502,584 | B1 | 1/2003 | Fordham | |
| 6,505,631 | B2 | 1/2003 | Fischer et al. | |
| 7,223,034 | B2 | 5/2007 | Hiyama | |
| 7,334,584 | B2 * | 2/2008 | Mathiez | A45D 40/267 132/218 |
| 7,841,794 | B2 | 11/2010 | Salciarini et al. | |
| 8,142,093 | B2 | 3/2012 | Vanoncini | |
| 9,028,161 | B2 * | 5/2015 | Stredak | A45D 40/267 401/122 |
| 2004/0184865 | A1 | 9/2004 | Carroll | |
| 2005/0175394 | A1 | 8/2005 | Gueret | |
| 2005/0220528 | A1 * | 10/2005 | Petit | A45D 40/267 401/122 |
| 2005/0286965 | A1 | 12/2005 | Dumler | |
| 2007/0079845 | A1 | 4/2007 | Gueret | |
| 2008/0060668 | A1 | 3/2008 | Legassie | |
| 2008/0115798 | A1 | 5/2008 | Rainey et al. | |
| 2009/0065019 | A1 | 3/2009 | Salciarini | |
| 2015/0182005 | A1 | 7/2015 | Pires et al. | |

* cited by examiner

DECORATIVE WIPERS FOR COSMETIC CONTAINERS

CROSS REFERENCE TO RELATED APPLICATIONS

The present patent application claims the benefit of and priority to U.S. Provisional Patent Application No. 62/191,181, filed Jul. 10, 2015, titled DECORATIVE WIPERS FOR COSMETIC CONTAINERS, the disclosure of which is incorporated herein by reference.

FIELD

The present application relates to the field cosmetic containers, more particularly to the design of wipers for such containers.

BACKGROUND

Cosmetic containers generally include a wiper near the top which is used to wipe away excess cosmetic product on an applicator (such as a brush) which is inserted into the bottle to obtain the product. New and alternative approaches to such devices are desired.

Overview

A first illustrative example includes a wiper for cosmetic products comprising a first end adapted to be placed at an opening or upper end of a cosmetic bottle and comprising a decorative design defining a first opening therethrough, the decorative design having a non-circular shape, a second end adapted to sit farther within the cosmetic bottle, the second end defining a second opening narrower than first opening in at least one dimension, a passage between the first opening and the second opening having walls which define a taper therebetween.

In another example, the second opening is circular and is sized and configured to wipe away excess product from an applicator passed therethrough.

In further examples, the decorative design is a heart, a star, a teddy bear, a snowman, a leaf, a flower, a brand insignia, or a geometric design.

Another illustrative example includes a cosmetic bottle for containing cosmetic product having inserted or built therein a wiper as in the above examples.

Another example includes a combination product of a cosmetic bottle for containing a cosmetic product having inserted or built therein a wiper as in the above examples and a combination cap and applicator for use therewith and inserted therein, wherein a shape of the second opening does not match a shape of the applicator.

A further example the combination product further comprises a cosmetic product contained in the cosmetic bottle.

Another illustrative example includes a method comprising using the combination product by loosening the combination cap and applicator from the bottle, and withdrawing an applicator through the wiper to remove excess product therefrom.

Another illustrative example includes a cosmetic applicator comprising a container for holding a cosmetic product, a wiper configured to be disposed within an opening of the container, and an applicator configured to be inserted through the wiper and into the container, wherein the wiper has a first end with a first opening adapted to be placed at the opening of the container, a second end with a second opening adapted to sit farther within the container, and a passage between the first and second openings having walls which define a taper therebetween, wherein the first opening is defined by a decorative design having a non-circular shape, wherein the second opening is narrower than the first opening in at least one dimension.

In a further example, the second opening has a shape that does not match a shape of the applicator.

In another example, the first opening has a shape that does not match the shape of the applicator.

In another example, the second opening is circular.

In a further illustrative example, a cosmetic applicator comprises a container for holding a cosmetic product, a wiper configured to be disposed within an opening of the container, the wiper having a first opening, a second opening, and a passage extending therebetween, the passage having a wall that tapers from the first opening to the second opening which is smaller than the first opening in at least one dimension, the first opening disposed adjacent the opening of the container, the second opening disposed farther into the container, the first opening defining a decorative design having a non-circular shape, and an applicator configured to be inserted through the wiper and into the container, wherein the second opening has a shape that does not match a shape of the applicator.

In a further example, the non-circular shape of the first opening does not match the shape of the applicator.

In another example, the second opening is narrowed in a manner typical of cosmetic wipers to a generally circular profile. Between the first end and the second end is a lumen or passage through which the cosmetic applicator may pass. The second end serves to wipe away excess product, in a manner similar to conventional wipers. The first end provides an aesthetically pleasing, or brand-defining useful, design. Between the two ends the interior walls of the wiper define the lumen or passage by tapering outward from the first end wiper to the second end.

An additional example includes a cosmetic bottle for containing cosmetic product having inserted or built therein a wiper as in the first illustrative example. Yet a further example also includes an applicator.

Still a further example includes a bottle having a wiper as in the first example, as well as one or more of a cap and an applicator, where the bottle also contains cosmetic product such as mascara, lip gloss or other product that may be provided in a container having a wiper.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
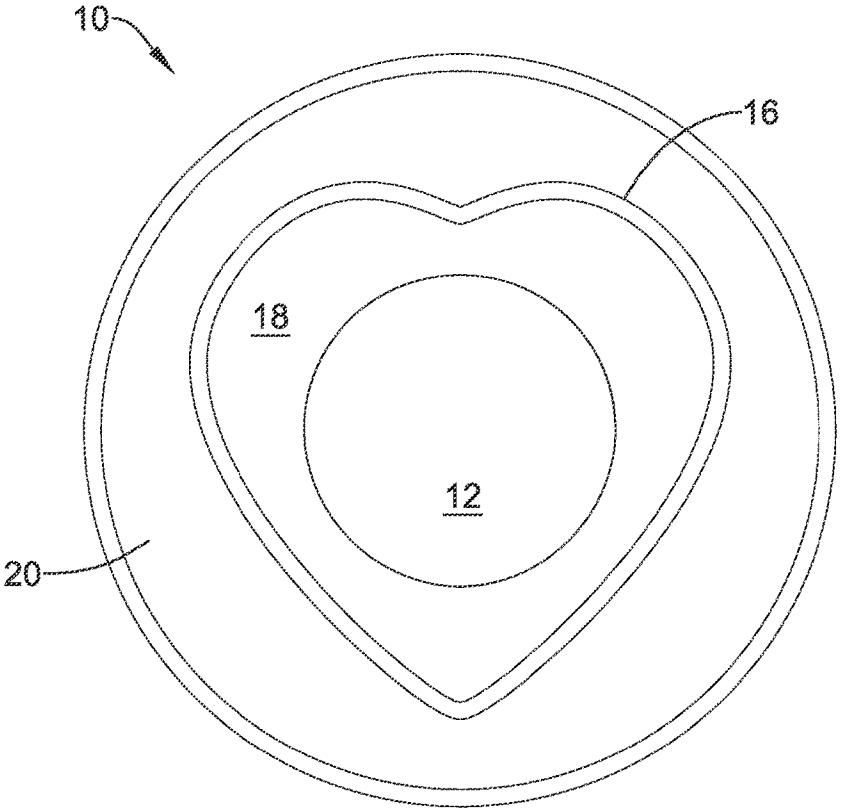
FIGS. 1-6 are top views showing illustrative decorative wipers, with the decorative designs shown.

FIGS. 1-6 are top views showing illustrative decorative wipers, with the decorative designs shown. FIG. 1 shows a heart design. The wiper 10 has a circular lower opening 12, and a decorative, "heart shaped" upper opening 16, surrounded by a face 20. Between these is a tapered wall section at 18. The lower opening 12 performs the function of removing excess product from an applicator passed therethrough, while the upper opening 16 provides an aesthetically pleasing design. The lower opening 12 is narrower than the upper opening 16 in at least one dimension. The shape of the lower opening 12 does not match the shape of the applicator.

In this example, and several that follow, the upper face 20 has a circular shape. The illustrative decorative design, on the other hand, is non-circular and/or does not match, either in proportion or general shape, the shape of the lower opening or the shape of the applicator. In some examples, a non-round shape may be used, or a larger-than-necessary overlap may be provided for the upper face. This can facilitate further design surrounding the upper opening 16. For example, a lion face could be shown, with the upper opening serving as the mouth, with surrounding features decoratively shown such as the eyes, nose and chin. Thus the upper opening itself may have a decorative and/or fanciful shape, which may be integrated into a larger design.

Figure 2:
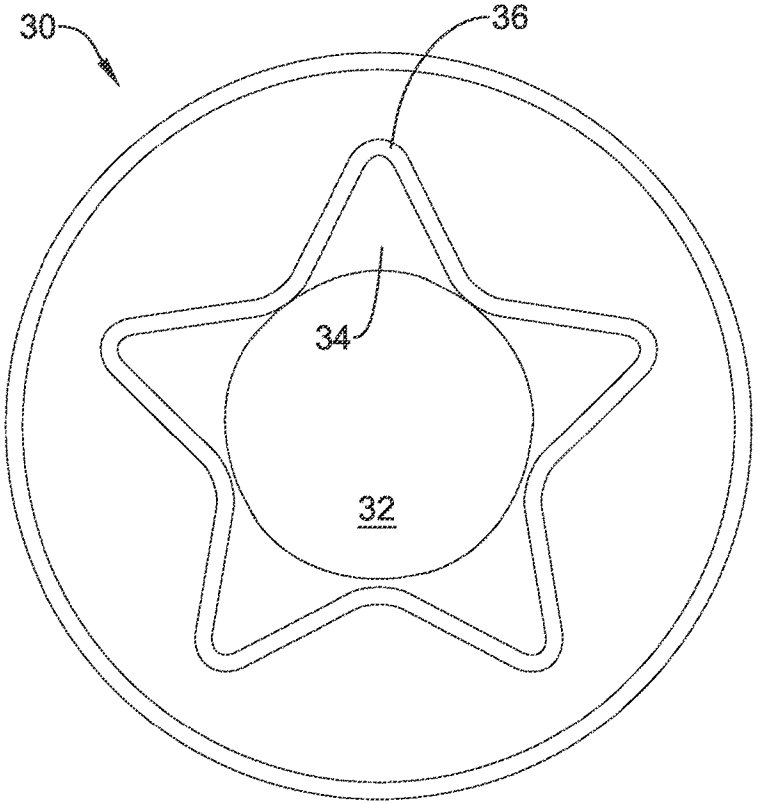

FIG. 2 shows another example. This time the wiper 30 includes the lower opening at 32, tapered wall at 34, and decorative upper opening at 36. Here the wall 34 tapers selectively in some areas to form the star pattern, but not on all sides.

Figure 3:
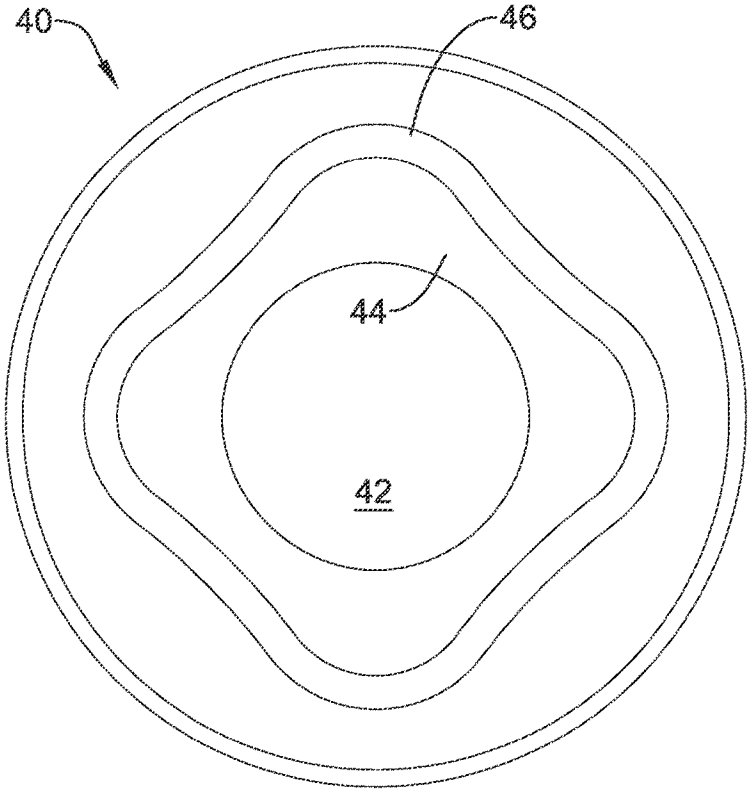

FIG. 3 shows another example. This time the wiper 40 includes the lower opening at 42, tapered wall at 44, and decorative upper opening at 46, to yield a geometric design resembling a rounded square.

Figure 4:
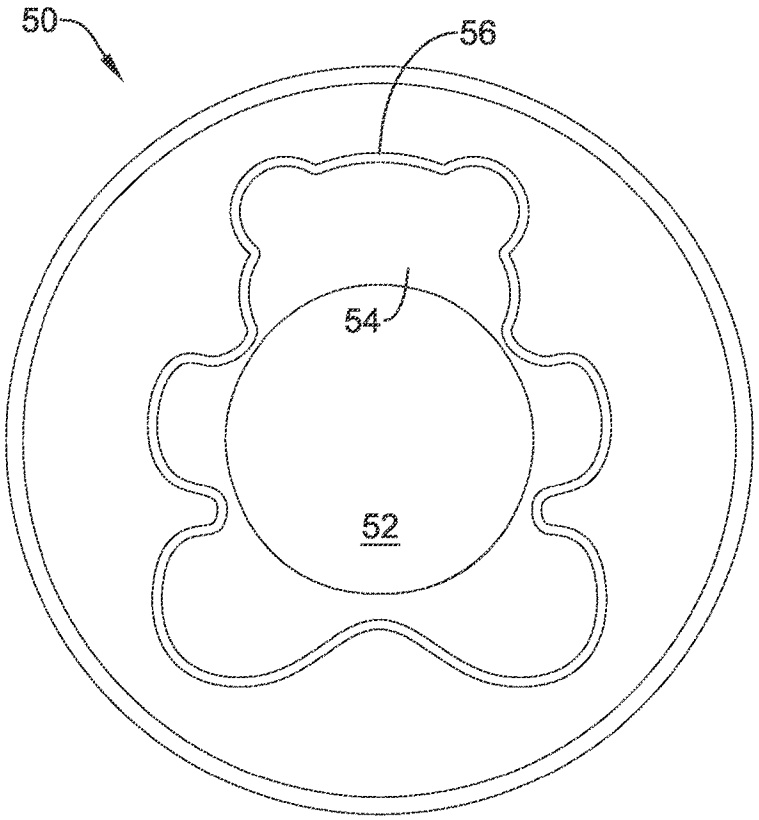

FIG. 4 shows another example. This time the wiper 50 includes the lower opening at 52, tapered wall at 54, and decorative upper opening at 56, to yield a geometric design resembling a teddy bear.

Figure 5:
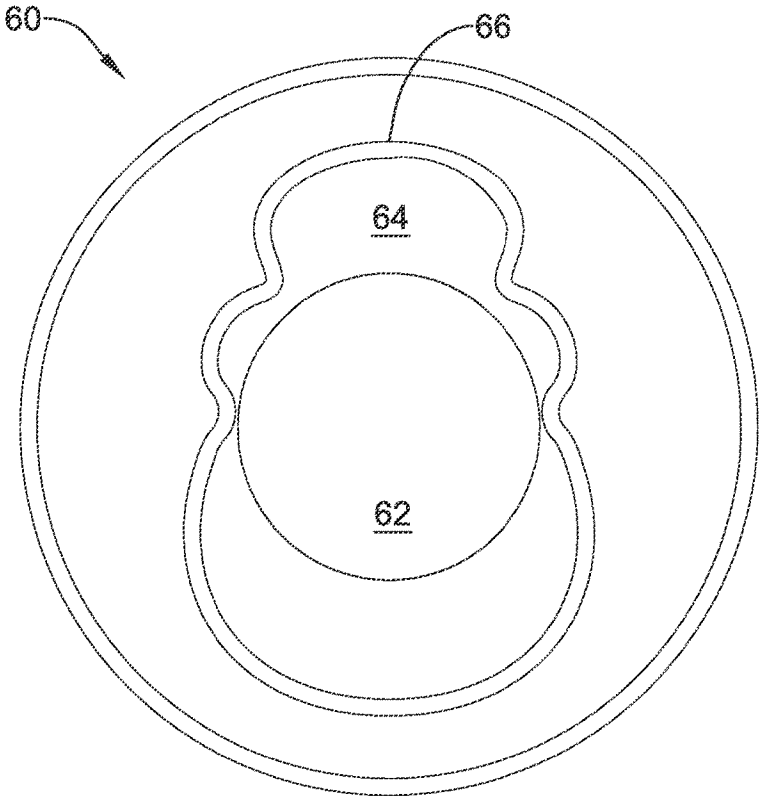

FIG. 5 shows another example. This time the wiper 60 includes the lower opening at 62, tapered wall at 64, and decorative upper opening at 66, to yield a geometric design resembling a snowman.

Figure 6:
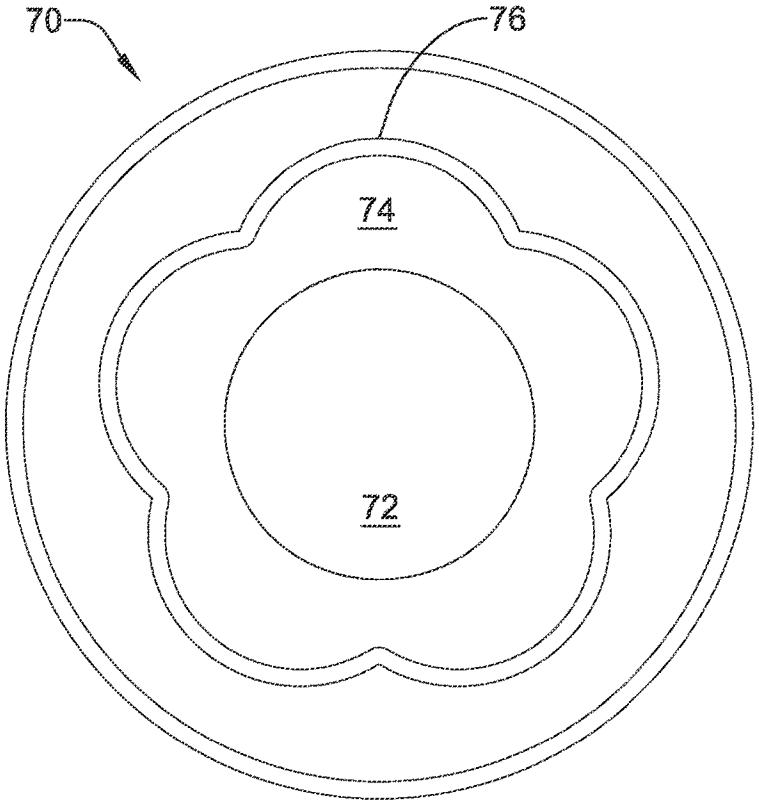

FIG. 6 shows another example. This time the wiper 70 includes the lower opening at 72, tapered wall at 74, and decorative upper opening at 76, to yield a geometric design resembling a leaf or flower.

Other decorative designs may include a brand insignia. One is the Lucky™ brand insignia, of a four leaf clover. Other insignias may be used instead.

Figure 7:
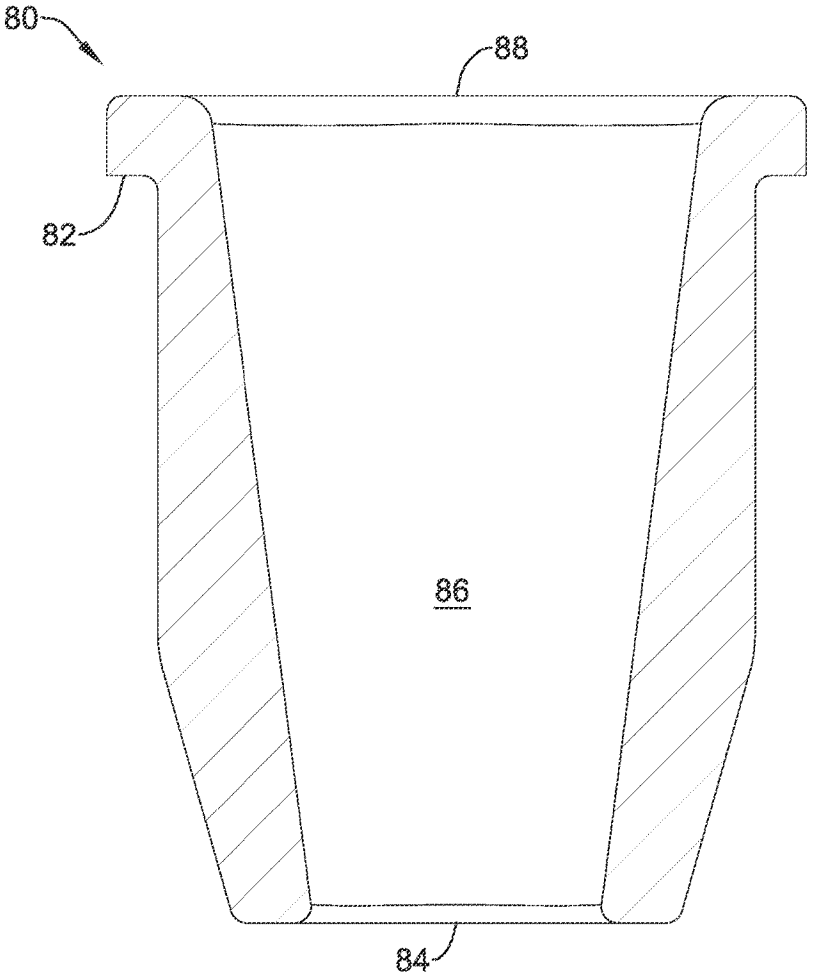
FIG. 7 is a cross section illustrating a taper between a first end of a wiper having a decorative design and a second end serving to wipe excess product from an applicator.

FIG. 7 is a cross section illustrating a taper between a first end of a wiper having a decorative design and a second end serving to wipe excess product from an applicator. The wiper 80 includes an upper lip 82 for securing its position in the opening of a bottle. The lower opening 84 is shown and a tapered lumen is created by wall 86 which expands out to upper opening 88. The lower opening 84 may be circular, oval, square, or other simple shape, but is a different shape from the upper opening 88. The lower opening 84 is smaller in at least one dimension than the upper opening 88. The smaller lower opening 84 serves to wipe excess product off the applicator as the applicator is withdrawn through the wiper 80. The shapes of the lower opening 84 and the upper opening 88 do not match, either in proportion or overall shape, the shape of the applicator. The upper opening 88 has a non-circular shape that defines a decorative design. While the taper shown in FIG. 7 is symmetric, it will be understood that different section views would show asymmetry either each on its own or relative to other section views of a single wiper, as the wall 86 tapers outward. The wall 86 tapers outward from the smaller lower opening 84 to the larger upper opening 88. The wall 86 may taper in a non-uniform manner to achieve the transition between the smaller simple shape of the lower opening 84 to the larger shape of the upper opening 88. The larger shape of the upper opening 88 may be more complex than the smaller shape of the lower opening 84. For example, as shown in FIG. 4, the wall 54 may taper in a non-uniform manner to achieve the transition between the small circular lower opening 52 and the large, complex teddy bear shaped upper opening 56. The difference in shapes and sizes of the upper and lower openings allows for a large, decorative and possibly complex upper opening 88 where the shape is readily seen by the user while providing a functional, smaller, simple lower opening 84 that serves to remove excess product from the applicator. The wall 86 taper provides a smooth transition between the upper opening 88 and the lower opening 84, allowing for excess product to be returned to the container. The tapered wall 86 also serves as a guide for inserting the applicator into the smaller lower opening 84.

Figure 8:
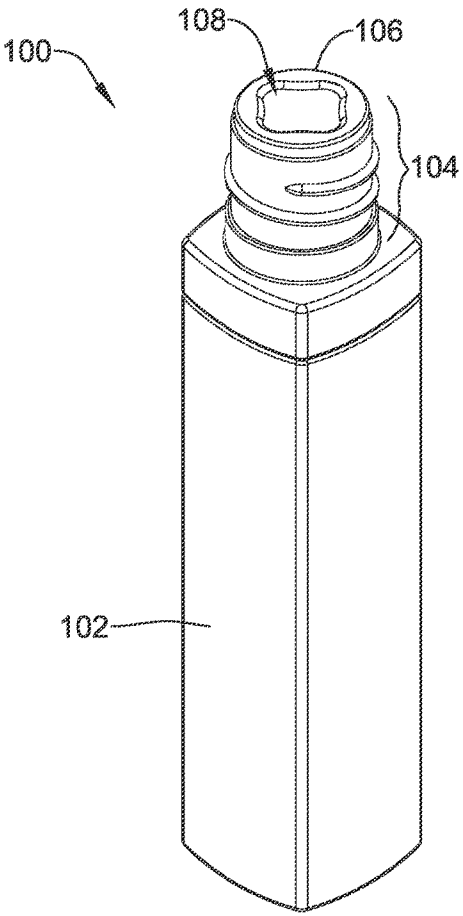
FIG. 8 is a perspective view of a bottle having a decorative wiper therein.

FIG. 8 is a perspective view of a bottle having a decorative wiper therein. The bottle assembly 100 is shown with the bottle including a container portion 102 for containing cosmetic product such as mascara or lip gloss, or other products. At the top of the bottle assembly 100 is the neck at 104 which is shown with threading to facilitate securing a cap thereon. The wiper 106 is inserted in the neck opening at 108. The wiper 106 is generally secured in place by interference fit, but could also be adhered, snap fitted, or twisted into place. The wiper 106 has a rounded square design at the upper opening 46, as shown in FIG. 3.

In some examples a wiper 106 may be sold as a standalone product. In other examples, the wiper 106 may be sold as part of the assembled bottle 100. In still further examples, the assembled bottle 100 with wiper 106 would be sold along with an associated cap or applicator/cap combination. In some examples, the assembled bottle 100 with wiper 106 with associated cap or applicator/cap combination would be sold filled with a cosmetic product.

Figure 9:
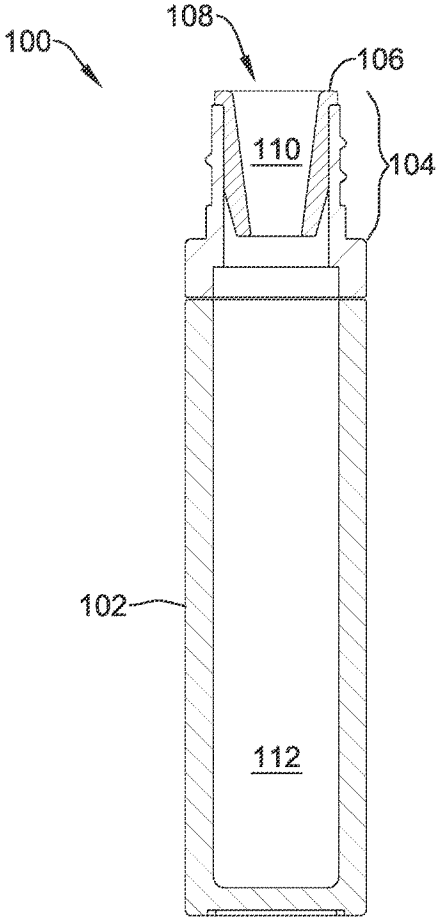
FIG. 9 is a section view of the bottle with wiper combination of FIG. 8.

FIG. 9 is a section view of the bottle with wiper combination of FIG. 8. The bottle assembly 100 includes the container portion 102 having therein a reservoir 112 to contain product and receive an applicator. At the top of the bottle assembly 100 is a neck at 104 having the threads for securing a cap or cap and applicator thereon. The wiper 106 is placed in the neck opening at 108, with a passage 110 therethrough.

Figure 10:
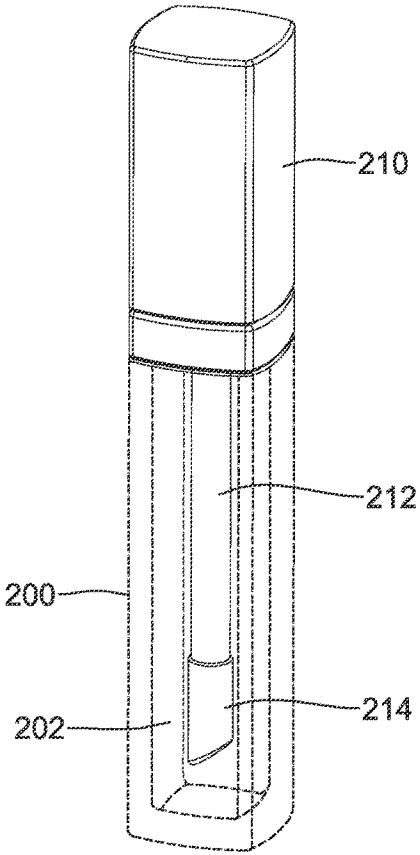
FIG. 10 shows a cosmetic applicator product having a bottle, cap and applicator.

FIG. 10 shows a cosmetic applicator product having a bottle, cap and applicator. The bottle assembly 200 may be as shown above, for example, in FIGS. 8-9, and includes therein a reservoir 202. The cap/applicator combination includes the cap 210 along with a shaft 212 that extends to an applicator 214, which may be a sponge, brush or any other applicator suited to applying cosmetics. The cap 210 may exclude the shaft 212 and applicator 214 in some examples, where the applicator is to be provided separately.

In a method, a user would remove the cap 210 to pull the attached shaft 212 and applicator 214 through the wiper (shown above in various figures), such that the wiper removes excess product from the applicator 214.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description.

The Abstract is provided to comply with 37 C.F.R. § 1.72(b), to allow the reader to quickly ascertain the nature of the technical disclosure. It is submitted with the understanding that it will not be used to interpret or limit the scope or meaning of the claims.

Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A wiper for cosmetic products comprising:

a first end adapted to be placed at an opening or upper end of a cosmetic bottle and comprising an upper face which surrounds a decorative design defining a first opening therethrough, the decorative design having a non-circular shape;

a second end adapted to sit farther within the cosmetic bottle, the second end defining a circular second opening narrower than first opening in at least one dimension; and a passage between the first opening and the second opening having walls which define a taper therebetween, wherein the walls taper selectively to form the non-circular shape of the first opening.

2. The wiper of claim 1 wherein the decorative design is a heart.

3. The wiper of claim 1 wherein the decorative design is a star.

4. The wiper of claim 1 wherein the decorative design is a teddy bear.

5. The wiper of claim 1 wherein the decorative design is a snowman.

6. The wiper of claim 1 wherein the decorative design is a leaf.

7. The wiper of claim 1 wherein the decorative design is a brand insignia.

8. The wiper of claim 1 wherein the decorative design is a geometric design.

9. A cosmetic bottle for containing cosmetic product having inserted or built therein a wiper as in claim 1.

10. A combination product of a cosmetic bottle having inserted or built therein a wiper as in claim 1 and a combination cap and applicator for use therewith and inserted therein, wherein a shape of the second opening does not match a shape of the applicator.

11. A combination product as in claim 10 further comprising a cosmetic product contained in the cosmetic bottle.

12. A method comprising using the combination product of claim 11, by:

loosening the combination cap and applicator from the bottle; and withdrawing an applicator through the wiper to remove excess product therefrom.

13. A cosmetic applicator comprising:

a container for holding a cosmetic product;

a wiper configured to be disposed within an opening of the container; and an applicator configured to be inserted through the wiper and into the container;

wherein the wiper has a first end with a first opening adapted to be placed at the opening of the container, a second end with a second opening adapted to sit farther within the container, the second end being circular, the wiper also defining a passage between the first and second openings having walls which define a taper therebetween, wherein the first opening is defined by an upper face which surrounds a decorative design having a non-circular shape, wherein the second opening is narrower than the first opening in at least one dimension.

14. The cosmetic applicator of claim 13, wherein the second opening has a shape that does not match a shape of the applicator.

15. The cosmetic applicator of claim 14, wherein the first opening has a shape that does not match the shape of the applicator.

16. The cosmetic applicator of claim 14, wherein the second opening is circular.

17. The cosmetic applicator of claim 14, wherein the decorative design of the first opening is selected from the group consisting of a heart, a star, a teddy bear, a snowman, a leaf, a flower, a brand insignia, and a geometric design.

18. A cosmetic applicator comprising:

a container for holding a cosmetic product;

a wiper configured to be disposed within an opening of the container, the wiper having a first opening, a second opening, and a passage extending therebetween, the passage having a wall that tapers from the first opening to the second opening which is smaller than the first opening in at least one dimension, the second opening being circular, the first opening disposed adjacent the opening of the container, the second opening disposed farther into the container, the first opening defining an upper face which surrounds a decorative design having a non-circular shape; and an applicator configured to be inserted through the wiper and into the container, wherein the second opening has a shape that does not match a shape of the applicator.

19. The cosmetic applicator of claim 18, wherein the non-circular shape of the first opening does not match the shape of the applicator.

* * * * *